United States Patent [19]

Kopesky

[11] Patent Number: 4,620,428

[45] Date of Patent: Nov. 4, 1986

[54] LOCK AND COUPLING FOR SECURING FIRE HYDRANTS

[75] Inventor: Albert B. Kopesky, Houston, Tex.

[73] Assignee: Productive Instrument & Machine, Inc., Houston, Tex.

[21] Appl. No.: 465,622

[22] Filed: Feb. 10, 1983

[51] Int. Cl.[4] ..... F16K 31/08

[52] U.S. Cl. ..... 70/175; 70/231; 70/232; 192/84 PM; 220/284; 251/65; 403/19; 411/910

[58] Field of Search ..... 70/175, 229, 413, 276, 70/231, 232; 411/402, 429, 910; 81/90 D, 121 A; 403/19; 192/84 PM; 220/284; 251/65

[56] References Cited

U.S. PATENT DOCUMENTS

| | | | |
|---|---|---|---|
| 1,397,876 | 11/1921 | Meldal | 81/90 D |
| 1,767,643 | 6/1930 | Baird | 70/231 |
| 2,092,572 | 9/1937 | Deane | 70/175 |
| 3,060,786 | 10/1962 | Flower | 70/231 X |
| 3,071,995 | 1/1963 | Ruthrauff, Jr. | 81/121 A |
| 3,840,041 | 10/1974 | McMurray | 251/65 X |
| 3,935,877 | 2/1976 | Franceschi | 411/910 X |
| 4,336,698 | 6/1982 | Hurd | 70/231 |
| 4,390,038 | 6/1983 | Salvato | 70/276 X |

*Primary Examiner*—Robert L. Wolfe
*Assistant Examiner*—Lloyd A. Gall
*Attorney, Agent, or Firm*—Gunn, Lee & Jackson

[57] ABSTRACT

A lock and coupling apparatus for securing fire hydrants is disclosed. The two piece apparatus comprises an inner member concentrically received within an outer cylindrical member. The inner member is formed with a socket for receiving the five sided hydrant valve post. A snap ring connects the outer member to the inner member while permitting rotational movement therebetween. A square lock pin moveable between locked and unlocked positions is provided to lock the inner and outer members so that rotational movement of the outer member is transmitted to the inner member. A specifically designed wrench for imparting rotary movement to the outer member is also disclosed.

3 Claims, 8 Drawing Figures

FIG. 6
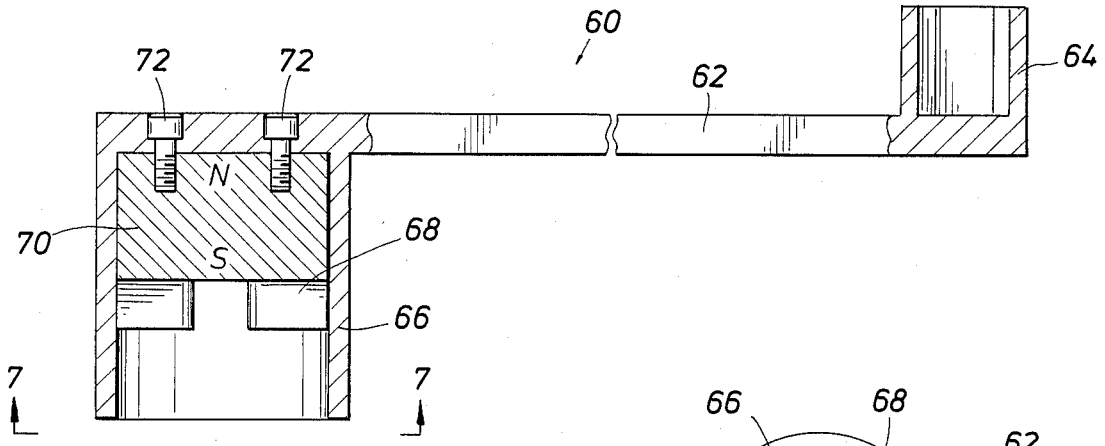
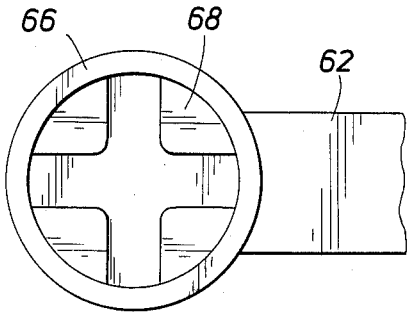
FIG. 7
FIG. 8
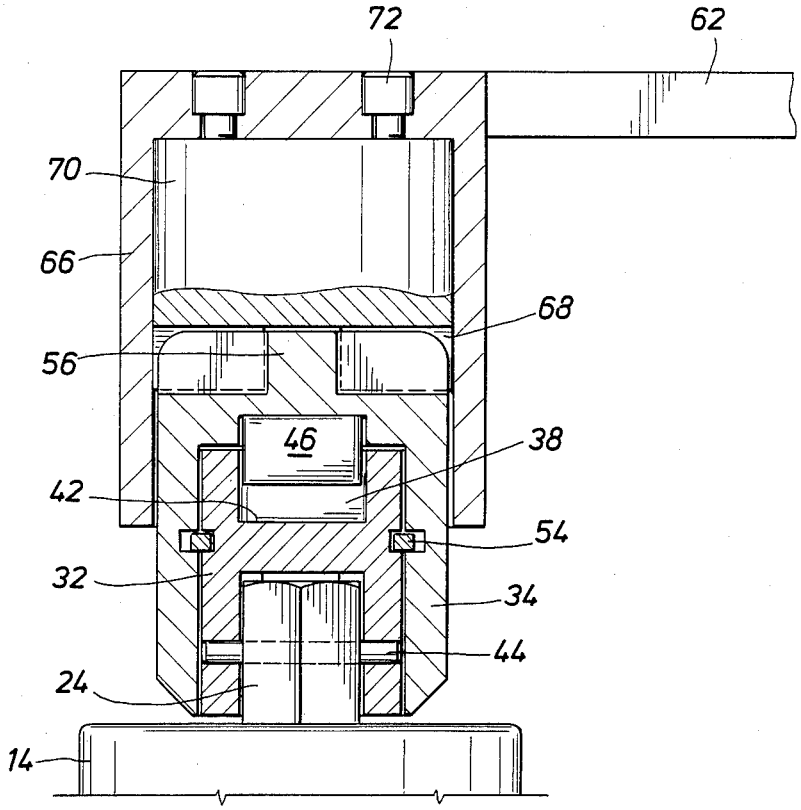

LOCK AND COUPLING FOR SECURING FIRE HYDRANTS

BACKGROUND OF THE DISCLOSURE

This invention relates to a lock and coupling apparatus adapted for use on a conventional fire hydrant.

A major problem experienced in many areas of the country is the unauthorized opening of fire hydrants. A fire hydrant is generally equipped with a plugged outlet and a valve actuated by a valve stem extending through the cap of the fire hydrant. The valve stem and outlet plug are usually provided with a five sided post which may be all too easily manipulated with tools usually found in most households. In the summer months, particularly during hot spells, fire hydrants will be turned on by children for playing in the water. The water is generally permitted to spray into the street and run off. When too many fire hydrants are opened in a particular locality, the water pressure in the area tends to drop dramatically so that sufficient water pressure is not available should an emergency arise.

It is an object of this invention to provide an apparatus for preventing the unauthorized opening of fire hydrants. This is accomplished by providing a lock and coupling apparatus adapted for use on conventional fire hydrants.

It is further an object of this invention to provide a wrench designed for opening a fire hydrant equipped with the lock and coupling apparatus of the invention.

SUMMARY OF THE INVENTION

The lock and coupling apparatus of the invention comprises concentrically arranged cylindrical members adapted for mounting about the five sided valve post of a conventional fire hydrant. The inner cylindrical member is provided with a five sided socket for receiving the five sided hydrant post. The outer cylindrical member is open at one end and closed at the other defining a cylindrical opening for receiving the inner member therein. A snap ring locks the cylindrical members together. The cylindrical members are provided with opposed square recesses defining a square cavity for receiving a square lock pin. The outer member is formed with an X-shaped lug which is received in a matching X-shaped recess in the wrench of the invention. The wrench includes a magnet in the socket thereof for attracting the square lock pin to a lock position.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 6 is a cross sectional, partially broken away view of the wrench of the apparatus;

FIG. 7 is a plan view of the wrench socket of the invention taken along line 7—7 of FIG. 6; and FIG. 8 is a cross sectional environmental view of the apparatus and wrench of the invention in engagement.

DETAILED DESCRIPTION OF THE PREFERRED EMBODIMENT

Figure 1:
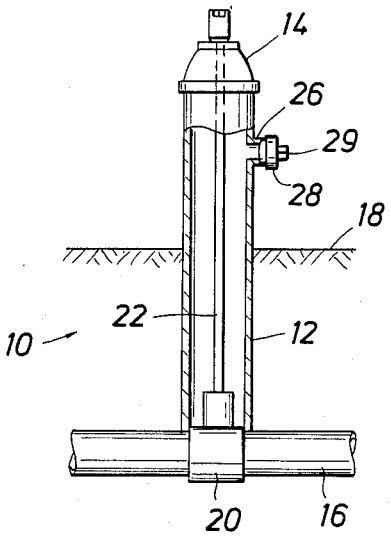
FIG. 1 is a cross sectional view of a standard fire hydrant provided with the lock and coupling apparatus of the invention.
Figure 3:
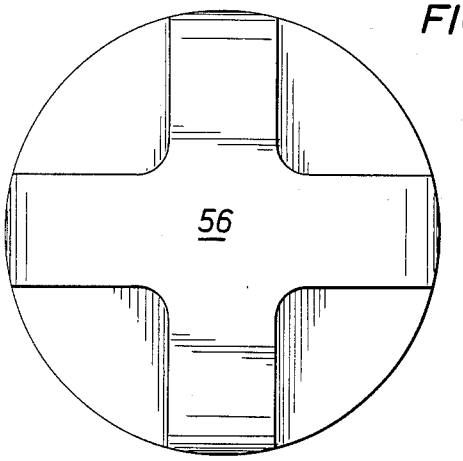
FIG. 3 is a top plan view of the apparatus taken along line 3—3 of FIG. 2.
Figure 4:
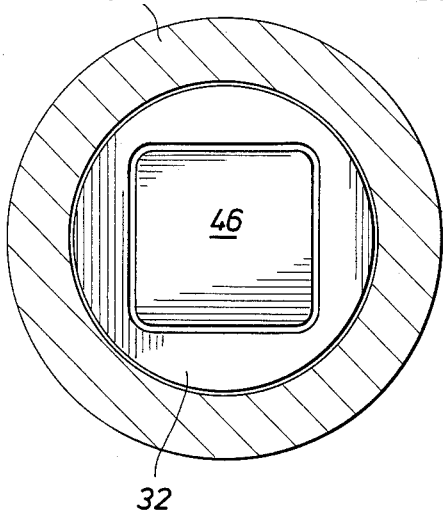
FIG. 4 is a cross sectional view of the apparatus of the invention taken along line 4—4 of FIG. 2.

Attention is first directed to FIG. 1 of the drawings. There, a standard fire hydrant identified by the reference numeral 10 is disclosed. The fire hydrant 10 includes an upstanding pipe 12 closed at the top end thereof by a cap 14. The pipe 12 of the hydrant 10 is connected to a water main 16 which in turn is connected to the water system providing water for the locality. The main 16 is generally located below the ground surface 18 as depicted in FIG. 1. The upstanding pipe 12 of the hydrant 10 extends approximately three feet above the ground surface 18. The pipe 12 is connected to the water main 16 in a known manner. A valve 20 is located at the point of connection so that water flowing through the water main 16 may be diverted through the pipe 12 upon manipulation of the valve 20 via a valve stem 22. The valve stem 22 extends upwardly from the valve 20 through the hydrant cap 14 terminating in a five sided post 24 best shown in FIG. 2. The pipe 12 is provided with an outlet spout 26 which is generally closed by a plug 28. A five sided post 29 protrudes from the plug 28. The plug post 29 is standard in size and shape so that the plug 28 may be unthreaded from the spout 26 using a wrench having a matching five sided socket conforming to the size and shape of the post 29.

Figure 2:
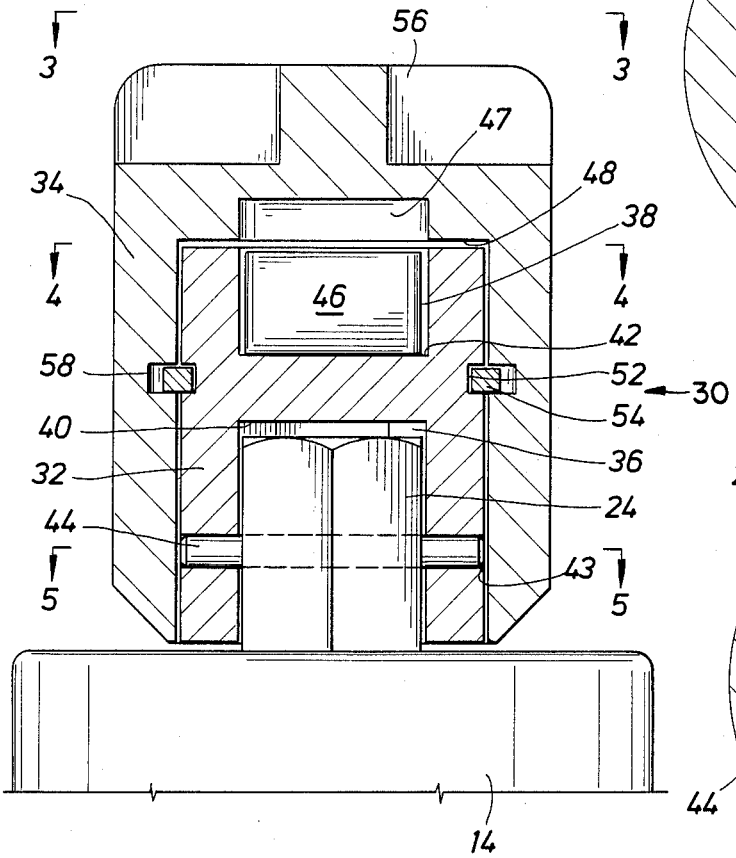
FIG. 2 is a cross sectional view of the apparatus of the invention.
Figure 5:
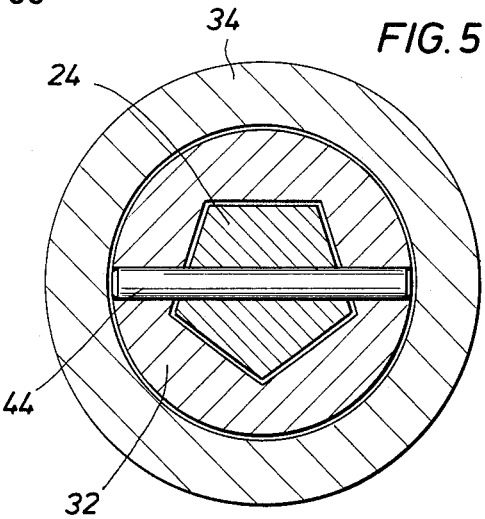
FIG. 5 is a cross sectional view of the apparatus of the invention taken along line 5—5 of FIG. 2.

In FIG. 2, a more detailed view of the lock and coupling apparatus of the invention is shown. The lock and coupling apparatus is generally identified by the reference numeral 30 and comprises an inner cylindrical member 32 and an outer cylindrical member 34. The inner member 32 comprises a generally cylindrical shaped body. The five sided socket receptacle extends into the body from one end and a square shaped recess 38 is formed in the body from the opposite end thereof. The recess terminates at a wall 42. The recess 38 is sized to receive a square lock block 46. The lock block 46 fits loosely within the recess 38 and does not protrude above the end face of the cylindrical member 32 when resting on the end wall 42 as best shown in FIG. 2; it is flush or even recessed below the face.

A transverse hole 43 extends through the cylindrical wall of the inner member 32 for receiving the lock pin 44 as shown in FIG. 2. To accommodate the lock pin 44, a hole is drilled through the post 24 of the hydrant 10 so that the apparatus 30 may be connected thereto.

The outer member 34 comprises a generally cylindrical body closed at the top end. A cylindrical opening extends from the open end of the outer member 34 and terminates at a transverse internal shoulder 48. The axial cavity in the outer member 34 is sized to loosely receive the inner member 32. A groove 58 is formed in the body of the member 34 and is oppositely located from a groove 52 formed in the body of the member 32. The grooves 58 and 52 form a channel for receiving a snap ring 54. The snap ring 54 prevents separation of the members 32 and 34 while permitting the outer member 34 to rotate or spin about the inner member 32. The uppermost end of the outer member 34 is formed into an X-shaped lug 56 providing a means for engaging the outer member 34 to impart rotational motion thereto. The lug is made of ribs of significant height and thickness to define a rugged gripping surface for a tool to be described. It is very heavy and rugged to have a life of many thousands of use; its size is beneficial for spacing as will be explained.

Referring now to FIG. 6, the wrench of the invention generally identified by the reference numeral 60 is shown. The wrench 60 comprises a handle 62 having oppositely facing sockets at the ends thereof. The socket 64 defines a five sided opening sized to accommodate the standard size and shape of the plug post 29 on the conventional fire hydrant 10. The socket 66 is configured to receive the upper end of the outer member 34 of the apparatus 30. The socket 66 defines a cylindrical opening which is interrupted by matching lugs 68 extending into the cylindrical opening from the inner wall of the socket 66. The lugs 68 are arranged to define an X-shaped recess for receiving the raised lug 56 on the member 34. A magnet 70 is threadably secured to the closed end of the socket 66 by a plurality of screws 72.

Turning now to FIG. 8, the operation of the apparatus 30 will be described. In FIG. 8, the apparatus 30 is attached to the post 24 of the fire hydrant 10 by slipping the inner member 32 about the post 24 and aligning the transverse holes 43 extending through the wall of the member 32 and the post 24. The lock pin 44 is pressed into position. The outer member 34 is journalled about the inner member 32 and positioned in the manner shown in FIG. 2. This is the usual relative position of the inner and outer members 32 and 34 respectively. In the position shown in FIG. 2, the outer member 34 may freely spin about the inner member 32. However, the outer member 34 cannot be separated from the inner member 32 because the snap ring 54 prevents such separation.

When opening of the valve 20 is required, the socket 66 of the wrench 60 is positioned in the manner shown in FIG. 8. The socket 66 is slipped over the outer member 34 so that the lug 56 is received in the recess defined by the lugs 68 and is in abutting engagement therewith. The lock block 46 is fabricated of magnetic material to be lifted by the attraction of the magnet 70 from its initial position shown in FIG. 2 to its locking position shown in FIG. 8. The lock block 46 is lifted into the internal recess 47 formed in the upper end of the outer member 34. In the position shown in FIG. 8, the lock block 46 locks the inner member 32 and outer member 34 together so that rotational motion imparted to the outer member 34 by manipulation of the wrench 60 is transmitted to the inner member 32 and likewise to the post 24 via the lock pin 44. In this manner, the valve 20 may be opened. Since the specially designed wrench 60 is not usually found in most households, the apparatus of the invention effectively prevents unauthorized opening of fire hydrants.

Because this device is intended to be left in the weather for 20 or more years, all of the parts are preferably made of stainless steel. The lock block 46 must have sufficient attraction to a magnet to move, the movement normally being a fraction of an inch. The magnet 70 is sized and spaced from the lock block 46 to scale the device; scaling prevents hand held magnets from resting on the lug 56 sufficiently close to raise the lock block 46. The shape of the lug 56, and its conformity with a magnet and lug drive makes opening the fire hydrant without a properly made wrench difficult, almost impossible.

The foregoing is directed to the preferred embodiment but the scope is determined by the claims which follow.

What is claimed is:

1. A lock and coupling apparatus for use on a fire hydrant, comprising:

(a) an inner cylindrical member incorporating a socket cavity extending axially from one end thereof and terminating at a first transverse wall, said socket cavity conforming in shape and size to receive an upstanding post located on the fire hydrant, said post being operatively connected to a valve;

(b) cooperative transverse hole and lock pin means extending through said inner cylindrical member at an axial location thereon for fastening said cylindrical member to the post;

(c) a first, single, centrally located, nonround recess extending longitudinally from the other end of said inner cylindrical member and terminating at a second transverse wall; said first nonround recess slidably receiving a single conformed lock block of magnetizable material;

(d) an outer cylindrical member having an axially extending opening terminating at an end wall forming a shoulder, said opening adapted to receive rotatably said inner cylindrical member and said nonround recess thereof, said outer member further including an upstanding, nonround lug projecting therefrom and being completely closed at an axial location corresponding to the axial location where the lock pin extends through said inner cylindrical member wherein the outer cylindrical member can not be locked with respect to the inner cylindrical member where the axial locations align;

(e) a second, centrally located, nonround conformed recess countersunk in said end wall of said outer cylindrical member, said second recess being located opposite said first nonround recess upon positioning of said inner and outer members cooperatively together, wherein said first and second recesses are adapted to receive said magnetizable lock block jointly therein;

(f) a ring received in oppositely facing grooves formed in said inner and outer cylindrical members defining a circumferential channel therebetween coupling said inner member to said outer member to prevent relative axial displacement;

(g) means for rotating said outer member to open and close the valve of the fire hydrant, said rotating means comprising a wrench having a handle including an end located socket adapted to receive said nonround lug projecting from said outer cylindrical member, said wrench further including conforming nonround lug engaging means within said socket for engaging said nonround lug projecting from said outer member; magnetizing means completely enclosed within said socket for magnetically attracting said magnetizable lock block; wherein said magnetizable lock block joins said inner member and outer member for joint rotation upon engaging the lug engaging means with the lug.

2. The lock and coupling apparatus of claim 1 wherein said nonround lug projecting from and outer cylindrical member is X-shaped and wherein said conforming, nonround lug engaging means is X-shaped.

3. The lock and coupling apparatus of claim 2 wherein the lock block is rectangular in cross-section as are the nonround recesses receiving same in the inner and outer cylindrical members.

* * * * *